United States Patent [19]

Collombin et al.

[11] 4,060,256

[45] Nov. 29, 1977

[54] DEVICE FOR CONNECTING A SKIER'S LEG TO A SKI

[75] Inventors: André Marcel Collombin, Avully, Switzerland; Georges Pierre Joseph Salomon, Bordet-a-Quintal, France

[73] Assignee: Ets. Francois Salomon et Fils S.A., Annecy, France

[21] Appl. No.: 635,592

[22] Filed: Nov. 28, 1975

[30] Foreign Application Priority Data

| | | |
|---|---|---|
| Nov. 28, 1974 | Switzerland | 15790/74 |
| Nov. 4, 1975 | Switzerland | 14192/75 |

[51] Int. Cl.[2] ..... A63C 9/08

[52] U.S. Cl. ..... 280/613; 36/117; 280/618

[58] Field of Search ..... 280/613, 618, 611; 36/120, 121, 118, 117

[56] References Cited

U.S. PATENT DOCUMENTS

| | | | |
|---|---|---|---|
| 3,619,914 | 11/1971 | Hanson et al. | 36/121 |
| 3,645,017 | 2/1972 | Hickman | 36/120 |
| 3,694,937 | 10/1972 | Salomon | 36/117 |
| 3,792,537 | 2/1974 | Plank et al. | 36/120 |
| 3,793,749 | 2/1974 | Gertsch et al. | 36/121 |
| 3,848,347 | 11/1974 | Hanson et al. | 36/120 |
| 3,861,067 | 1/1975 | Koyama | 36/120 |
| 3,868,783 | 3/1975 | Caporicci | 36/120 |
| 3,909,028 | 9/1975 | Courvoisier et al. | 280/613 |
| 3,947,051 | 3/1976 | Sittmann | 280/611 |

FOREIGN PATENT DOCUMENTS

| | | | |
|---|---|---|---|
| 2,308,754 | 9/1974 | Germany | 280/611 |
| 465,466 | 12/1968 | Switzerland | 280/629 |

*Primary Examiner*—Joseph F. Peters, Jr.
*Assistant Examiner*—David M. Mitchell
*Attorney, Agent, or Firm*—Young & Thompson

[57] ABSTRACT

Apparatus for connecting the leg of a skier to a ski comprises a casing comprised of rigid sections articulatedly interconnected for vertical swinging movement relative to each other about horizontal axes perpendicular to the length of the ski. In a preferred form, four such elements are provided, one comprising a sole or base, another comprising an upper pivotally mounted to the front of the base, and the third and fourth forming the front and rear of a boot top, at least one of which is pivoted to the rear of the base, the other being pivoted also to the rear of the base or to the rear of the upper. The various elements can be latched together in closed relationship; and means are provided for deliberately unlatching the elements to free the skier's foot, or for automatically unlatching the elements upon excessive forward or rearward bending or force application, or excessive torsional force. A waterproof sock can be provided within the casing.

12 Claims, 32 Drawing Figures

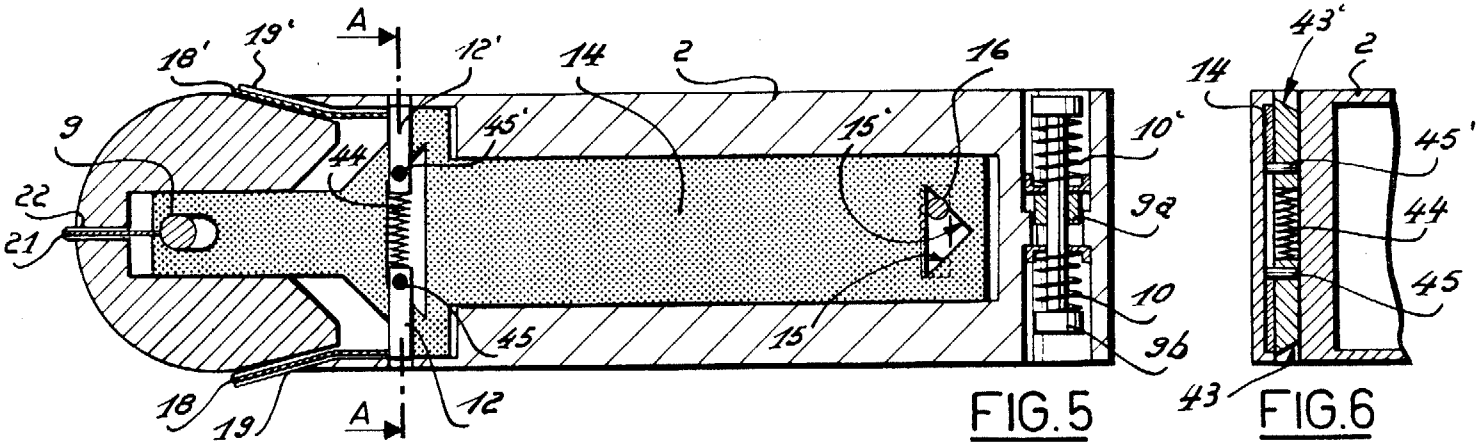
FIG. 6
FIG. 5
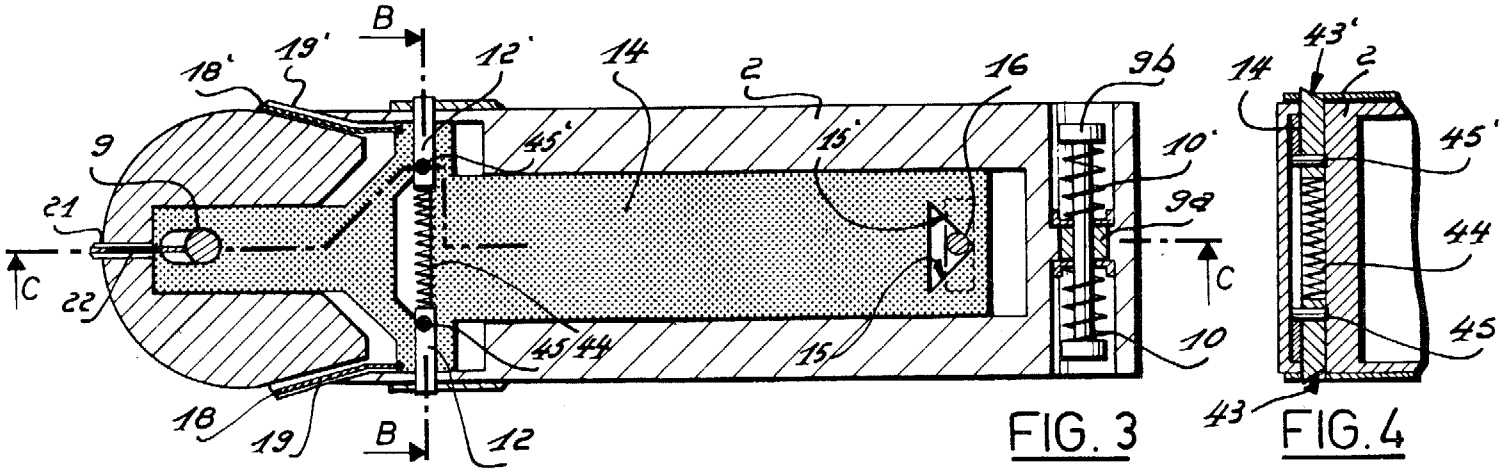
FIG. 4
FIG. 3

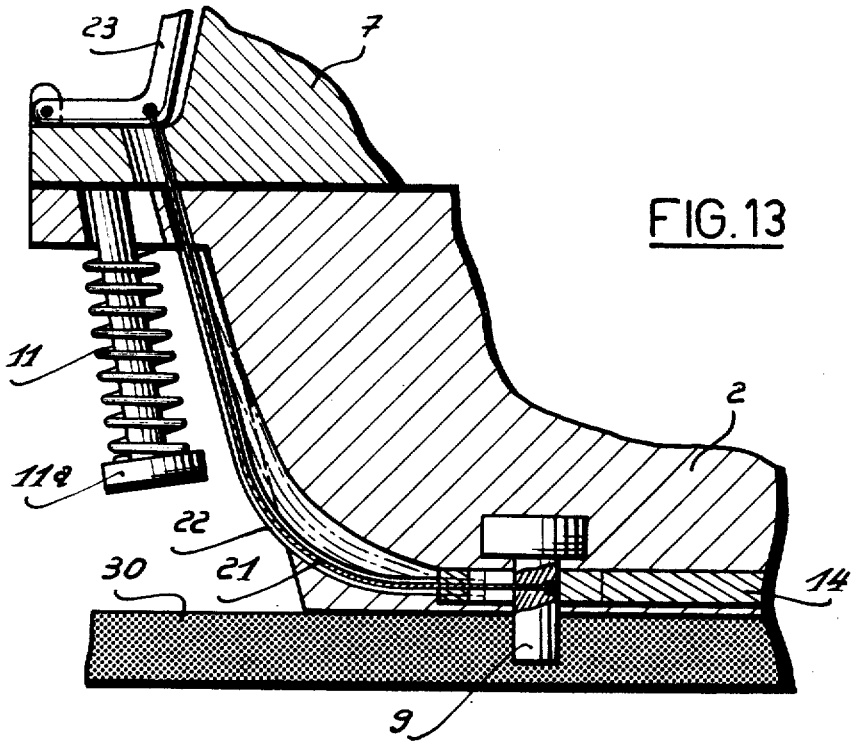
FIG. 13
FIG. 17
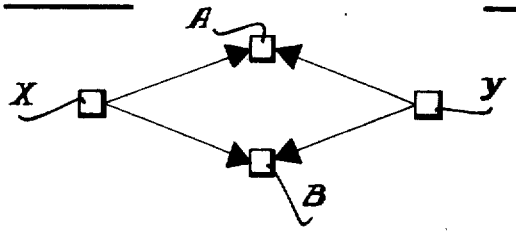
FIG. 19
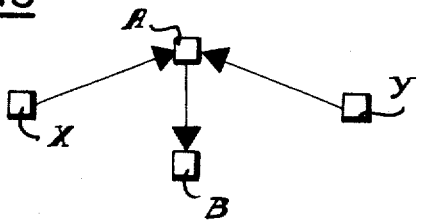
FIG. 18
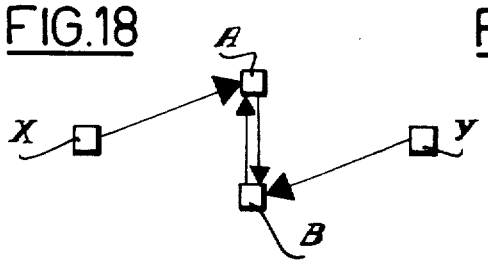
FIG. 20
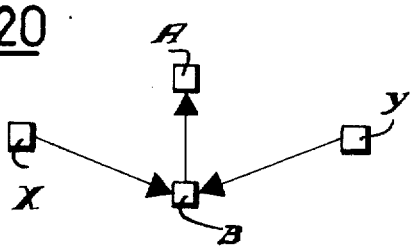

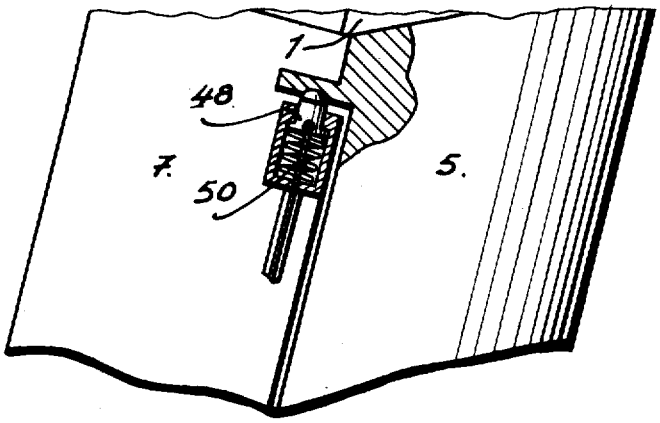
FIG.16
FIG.15
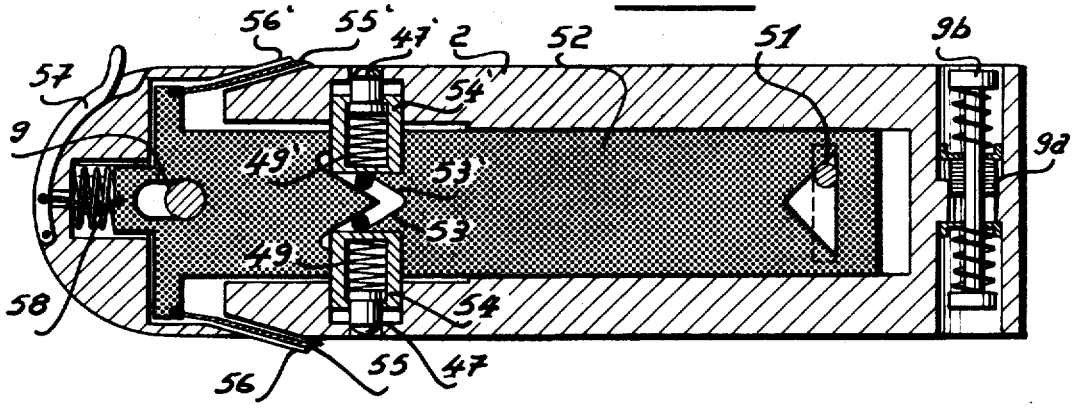
FIG.14
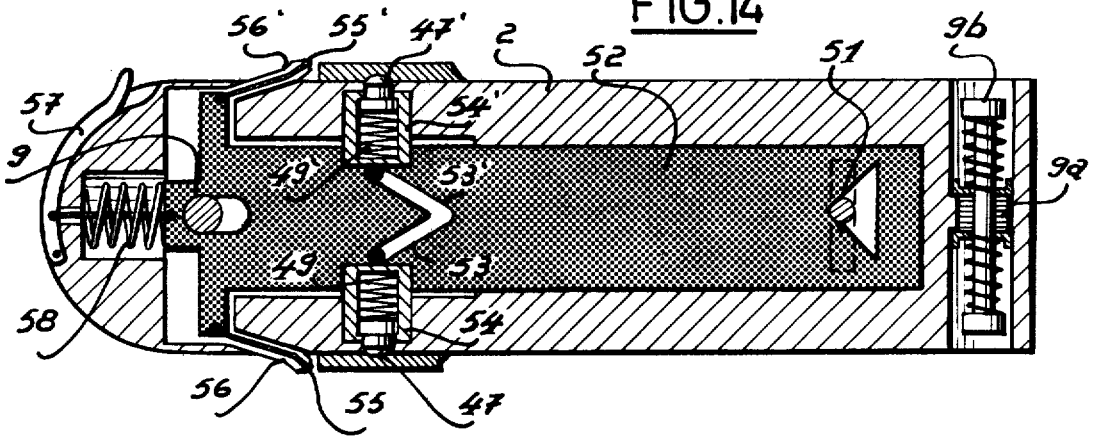

DEVICE FOR CONNECTING A SKIER'S LEG TO A SKI

Ski boots should have a number of characteristics that often seem to be mutually exclusive, for example rigidity and comfort, strength and lightness, etc. It is difficult to satisfy these requirements by a boot comprising a single member. A number of efforts have been made to devise ski boots comprised by several members each performing its own function; however, the constructions that have been thus far provided, such as the clamshell-construction in which two parts of the boot are articulated at the level of the sole along an axis extending lengthwise of the sole, have not been entirely satisfactory. For example, with such boots, it is necessary to secure them to the feet before attaching them to the skis.

Ski boots are known with bindings whose release is effected by separation of the boot from the ski. These boots have the disadvantage of being uncomfortable and heavy and their release depends on the condition of the boot and hence is not dependable; for example, the ease of release may vary as the degree to which the boot sole is worn down.

Ski boots are also known comprising a rigid body and a removable sock, the body providing strength and the sock providing comfort. Such socks provided with bindings solve the problem of comfort and weight but not the problem of reliable unlatching, which is aggravated when snow becomes packed between the boot and the ski.

French Pat. No. 2,218,913 discloses a boot whose unlatching takes place between the casing and the sock, the unlatching being controlled by hydraulic means. This solves the problem of comfort, but arrangements involving conventional shell construction do not provide for lateral security. Moreover, the shell must perform the two contradictory functions of being rigid when skiing but flexible so as to unlatch when the skier falls, even though it is not articulated.

The present invention provides a ski boot constituted by a rigid articulated body and a sock, boot or other flexible member permitting movement. In this way, the problems of comfort and of movement are resolved. The release is effected by separation of the sock from the boot body; and in this way the problems of reliability of release are solved.

The accompanying drawings show schematically and by way of example several embodiments of ski boot according to the invention.

FIG. 3 is a cross-sectional view from above showing the torsional unlocking control mechanism in its locked position;

FIG. 4 is a cross-sectional view on the line B—B of FIG. 3 with the locking mechanism in the engaged position;

FIG. 5 is a view similar to FIG. 3 but showing the torsional unlatching control mechanism in its unlocked position;

FIG. 6 is a cross-sectional view taken on the line A—A of FIG. 5 with the locking mechanism in its open position;

FIG. 13 is a detailed view of the flexural control system and the unlatching arrangement upon falling forward. The rest position of the cable and its sheath are shown in full line and their position at the moment of unlatching in phantom line;

FIG. 14 is a view similar to FIG. 3, but showing a modified construction in its rest position;

FIG. 15 is a view similar to FIG. 14 but showing the parts in their unlatched position;

FIG. 16 is a view partly in cross section of the pin locking arrangement for the embodiment of FIGS. 14 and 15;

FIGS. 17 through 20 show schematically the four contemplated unlatching arrangements;

Figure 1:
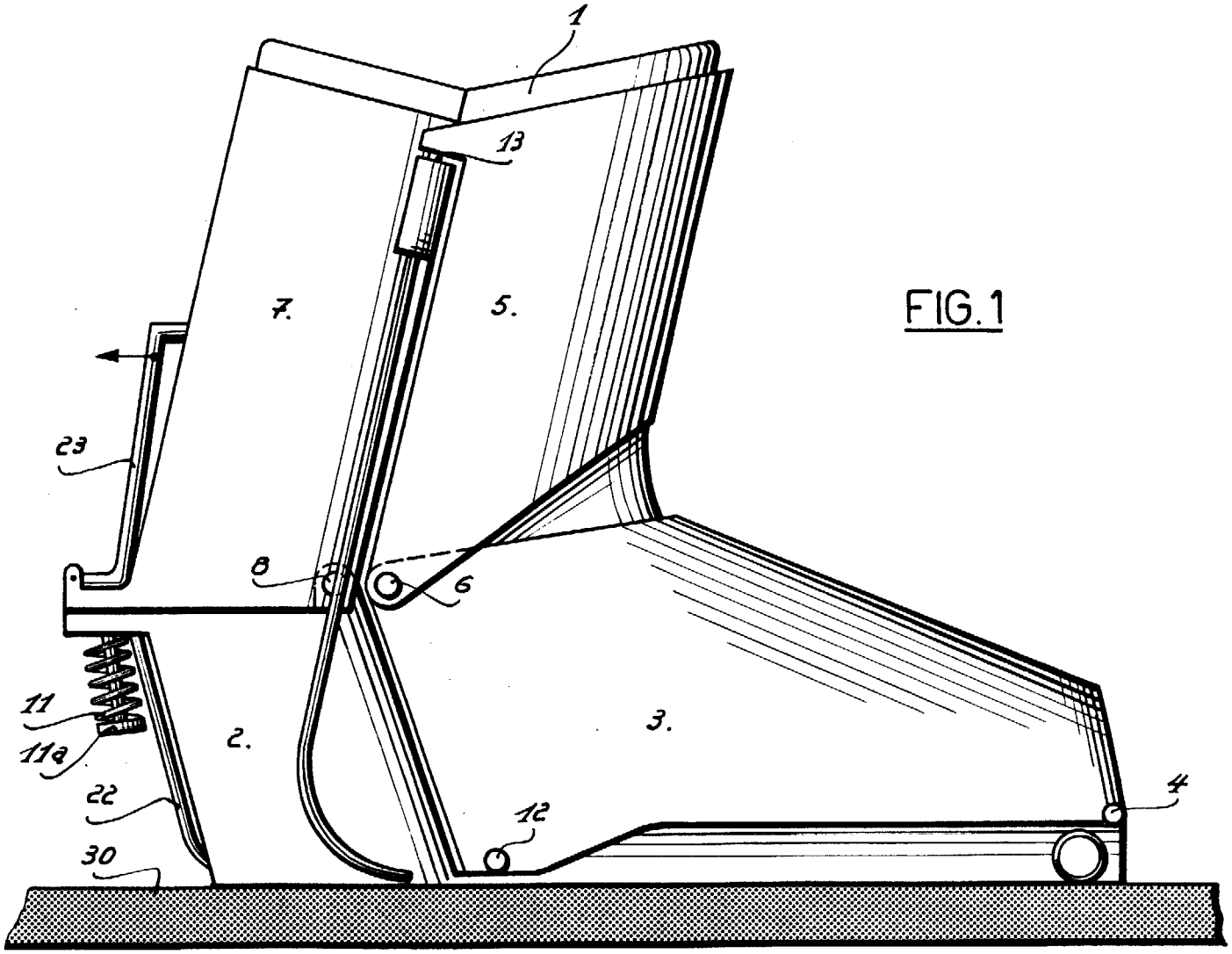
FIG. 1 is an elevational view of the boot.

In general, the present invention comprises a ski boot including an internal sock and an external frame or shell of several parts articulated to each other. Means for locking the shell in the service position are provided which are so arranged as to unlock the parts of the shell when subjected to excessive force in such a way as to free the sock, the shell remaining or not fixed to the ski.

The unlocking arrangement disclosed by way of example in FIG. 17 comprises two systems for closing the casing indicated at A and B and two systems represented by X and Y which above a certain value, which is ordinarily adjustable, of the couple or force or angle, cause unlatching to open the casing.

Several control means for unlatching and release are shown in FIGS. 17-20. In the first, shown in FIG. 17, X and Y separately control A and B, the closing and opening are effected by controlling X or Y or A and B.

In the second arrangement shown schematically in FIG. 18, X controls A which transmits control to B;

while Y controls B which transmits control to A. The opening and closing are effected by control of X or of Y or of A and B.

In the third arrangement shown in FIG. 19, X and Y control A which transmits control to B. The opening and closing may be effected by acting on X or on Y or on A.

In the fourth arrangement shown in FIG. 20, X and Y control B which transmits control to A. The opening and closing may be effected by acting on X or on Y or on B.

The illustrated embodiment shows by way of example the fourth arrangement, namely, unlatching with control of opening and closing by acting on X. However, it will be evident that embodiments within the scope of the invention can use any of the other illustrated arrangements.

A particular embodiment of the invention is illustrated in FIGS. 1–6 and 13. In those figures, the ski boot is constituted by a shell or casing of a rigid material such as reinforced synthetic resin, metal, etc., and a sock 1 in a flexible material such as leather, polyurethane foam, rubber, etc., having a sole resistant to wear and abrasion. The sock should be of waterproof material so as to be used in snow.

The shell or casing is constituted by a base 2 comprising a sole and a part which surrounds the heel of the skier, and by an upper 3 articulated to the base of the shell on the forward part of the shell about a pivot 4, and by a forward part 5 of the boot top which is articulated on upper 3 by pivot 6, a rear part 7 of the boot top being articulated at its forward lower portion to the upper rear portion of the base 2 by the pivot 8.

All the pivots of the casing are substantially perpendicular to the lengthwise extent of the sole and the ski.

The boot is connected to the ski by means of the base 2. The latter is rotatable about a pivot 9 which lies substantially on the axis of the leg of the skier. Springs 10 and 10' disposed in the forward part of base 2 maintain the boot parallel to the ski by bearing against a medial abutment **9*a* fixed to the ski and against a through bolt 9*b***. The securement of the casing on the ski is thus permanent; however, in a modified form the boot is also removably secured to the ski to provide for separation of the casing from the ski.

Flexure of the top of the boot 5, 7 is controlled by a spring 11 which is compressed during this flexure. This compression is regulable and can be predetermined by means of a screw **11*a***. Other means of controlling the flexure may be utilized without departing from the scope of the invention.

The casing is closed by locking the upper 3 on the base of the shell 2 by means of pins 12 and 12' and locking the forward portion 5 on the rear portion 7 by pins 13 and 13' located in those respective portions of the boot top. By pressure on the upper 3, pins 12 and 12' provided with ramps 43 and 43' are pressed in against the action of spring 44 and automatically catch in the upper 3. Closing of the part 5 on part 7 of the top of the boot is analogous to the closing of upper 3 on the base of the shell. This system of closing of the casing may be insufficient to hold the foot and may require a locking system for the foot which is independent of the closing system.

The torsional unlatching is effected by unlocking pins 12, 12' and 13, 13', controlled by displacement of the plate 14 which is slidably disposed in the interior of the sole. Springs 10 and 10' oppose the rotation of the boot about pivot 9. This arrangement is described in Swiss Pat. No. 465,466. When the torsional couple is sufficiently great, the boot rotates about pivot 9. When the ramps 15 or 15' bear on pin 16 which is fixed to the ski, the plate 14 is displaced longitudinally forwardly of the boot and retracts the pins 12 and 12' by means of ramps 43 and 43', the pins 45 and 45' also being withdrawn, against the action of springs 44.

Plate 14 controls the displacement of cables 18 and 18' in their sheaths 19 and 19' secured to the base of shell 2. These cables retract the pins 13 and 13', which disconnects parts 5 and 7 of the top of the boot. The pins 12, 12', 13 and 13' being retracted, the torsion spring 20 pivots the upper 3 as well as the forward part 5 of the boot top.

The base of the shell as well as the rear portion 7 of the boot top will be of such size and shape that when the parts 3 and 5 are open, the sock 1 can freely leave the casing.

Figure 2:
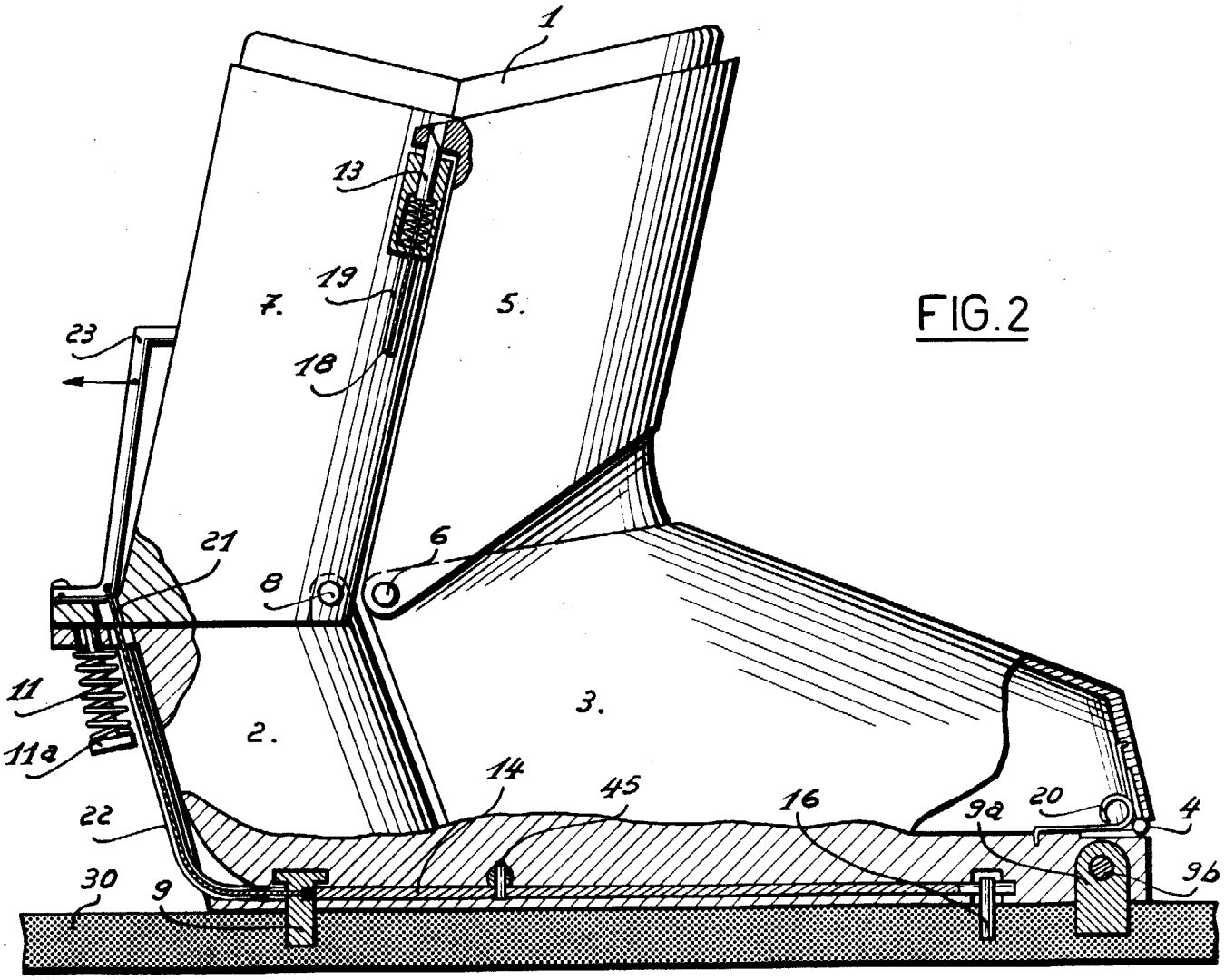
FIG. 2 is a view similar to FIG. 1 but in which part of the boot has been cut away on the line C—C of FIG. 3.
Figure 7:
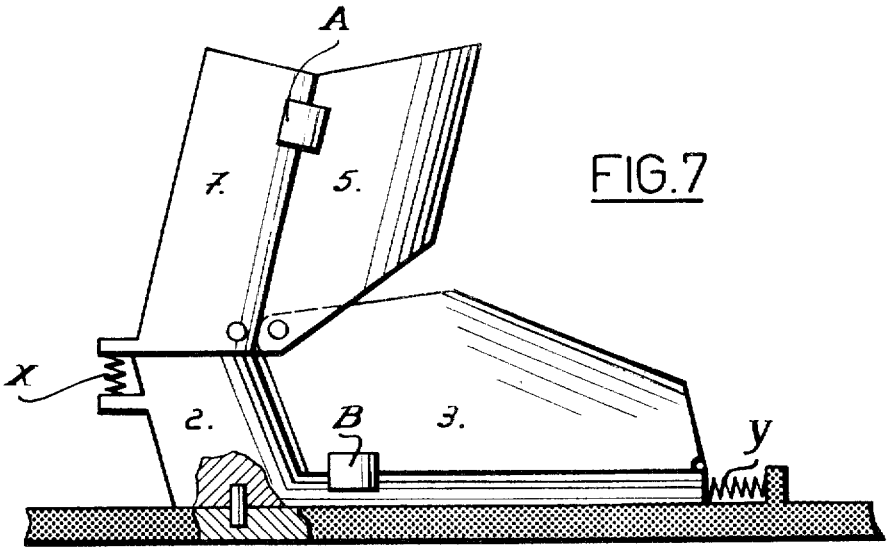
FIG. 7 shows the overall unlocking arrangement for the embodiment disclosed in the present application.

The unlatching action upon excessive forward flexure is shown in FIGS. 2 and 13. Upon excessive forward bending, the rear part 7 pulls on the cable 21 whose end if fixed to pivot 9. Sheath 22 surrounding cable 21 bears on plate 14 which moves lengthwise forwardly and frees the pins 12, 12', 13 and 13' in a manner similar to that of unlatching by torsion.

The deliberate opening of the casing is shown in FIGS. 2 and 16. Taking off the boot is effected by separation of the sock relative to the casing upon opening of the casing. By rotation of the lever 23 in the direction of the arrow in FIGS. 1 and 2, one thus pulls on the cable 21 whose sheath 22 presses the plate 14 which unlocks the pins 12, 12', 13 and 13', as in unlatching during forward falling. The sock 1 thus may be withdrawn from the boot.

Figure 9:
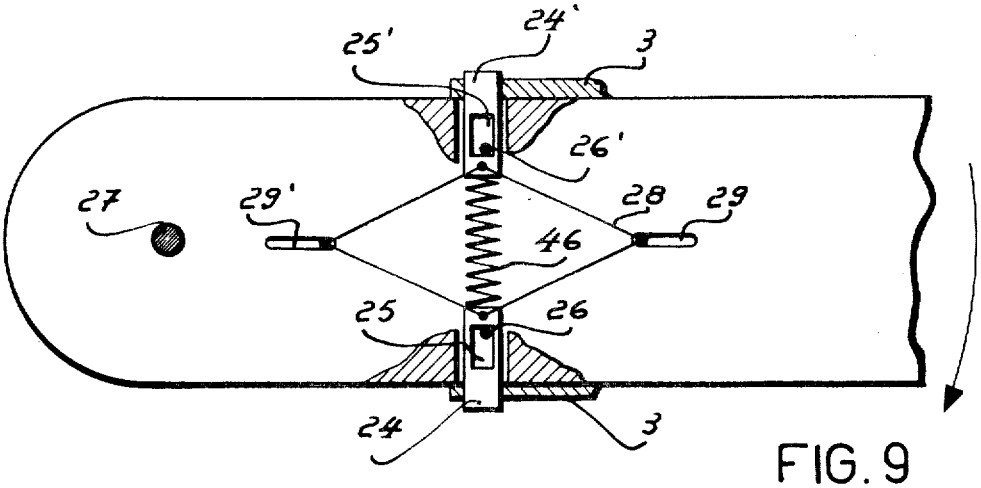
FIGS. 9 and 9A are views from above showing a particular embodiment of torsional unlatching.
Figure 9A:
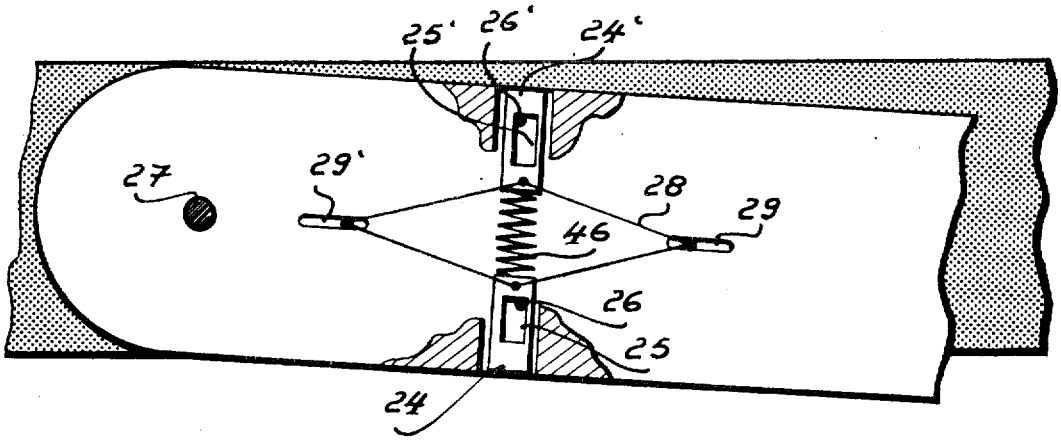

A modified form for unlatching upon torsion is shown in FIGS. 9 and 9A. The pins 24 and 24' are provided with recesses 25 and 25'. The form of these recesses permits rotation of the sole 2 relative to the ski. Pivot pins 26 and 26', fixed to the ski, pass through openings 25 and 25' of the pins 24 and 24'. In the rest position, the sides of the openings 25, 25' are pressed against the pins 26, 26' by a compression spring 46. Upon rotation about pivot 27 in the direction of the arrow, the pin 24 cannot follow the rotation of the sole because the opening 25 bearing against pin 26 (secured to the ski) prevents it. Therefore the pin 24 is withdrawn from the upper 3. Parallelogram linkage 28 connects pins 24 and 24' in such a way that they undergo movement in opposite directions from each other. Pin 24 being retracted, the parallelogram linkage effects the retraction of the pin 24' which permits this displacement. The two pins 24 and 24' are thus retracted and the upper 3 is free and opens thanks to the action of spring 20. During rotation of the boot in the opposite direction from that shown in FIG. 9, the roles of the pins 24 and 24', of the pins 26 and 26' and of the openings 25 and 25' are reversed. The parallelogram linkage 28 and the grooves 29 and 29' which permit the simultaneous movement of the pins 24 and 24' may be replaced by gear systems or levers.

FIG. 9A shows the device in the unlatched position.

Figure 11:
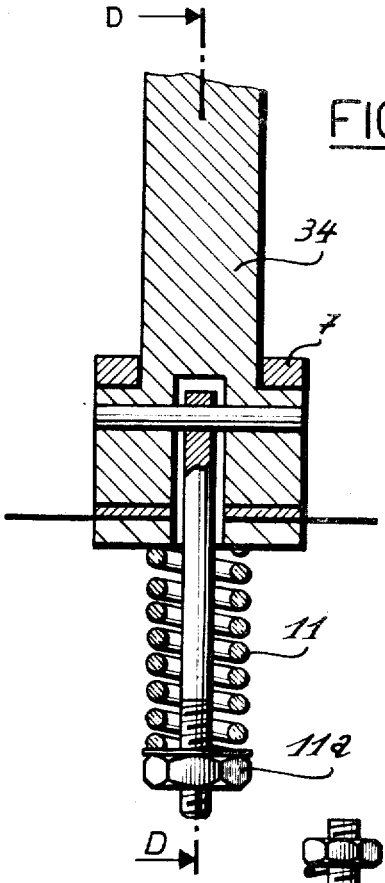
FIG. 11 is a cross-sectional view taken on the line E—E of FIG. 10.
Figure 10:
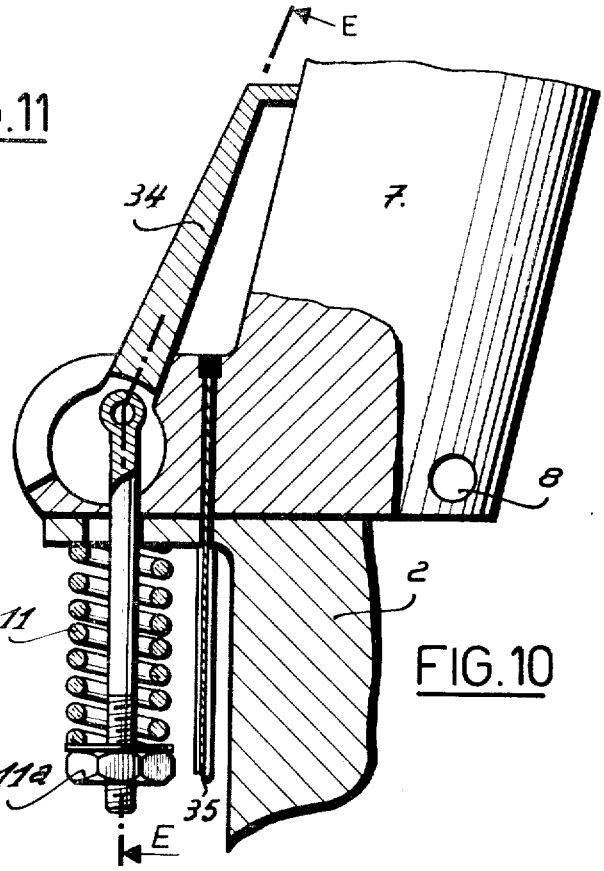
FIG. 10 is a cross-sectional view on the line D—D of FIG. 11, of a particular boot release mechanism.

Another unlatching mechanism is shown in FIGS. 10 and 11. By rotating lever 34 counterclockwise as seen in FIG. 10, the skier releases the compression of the spring 11. Then by flexing his leg, the skier acts on the cable 35 which, by a system identical to that of FIGS. 1–6 and 13, unlocks the closure pins.

Figure 12:
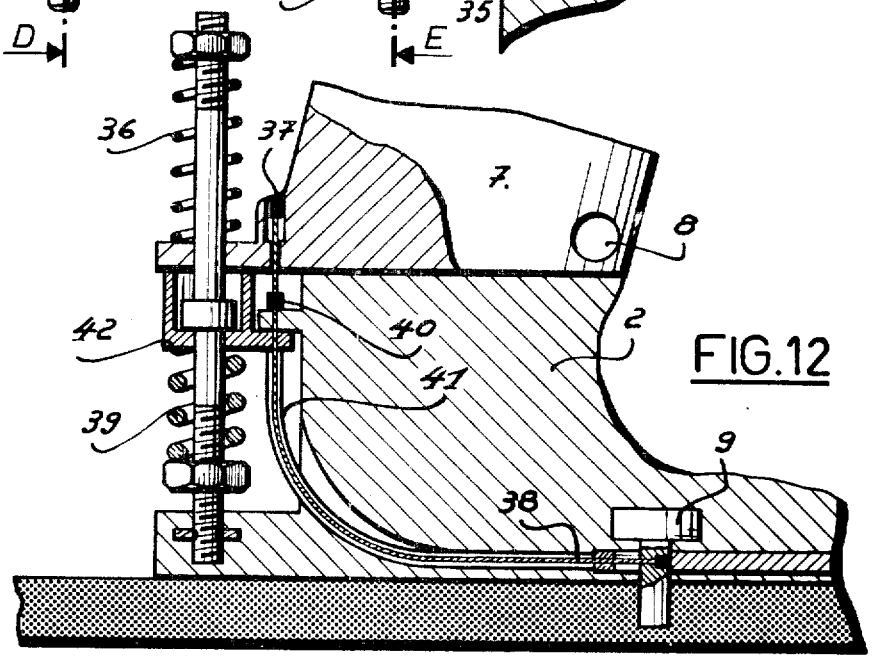
FIG. 12 is a cross-sectional view of a particular control system for unlatching upon bending.

FIG. 12 shows a system which imparts to the boot top a rigidity which is different when the skier leans forwardly or rearwardly. When the skier leans forwardly, the boot top swings clockwise. Spring 36 is compressed and permits bending of the leg. The end 37 of the cable 38 is disposed in such a way that this bending is possible. Above a certain flexure, which is adjustable, the cable 38 controls the opening of the casing by a system analogous to that described in connection with FIGS. 1–6 and 13.

When the skier leans rearwardly, the boot top flexes in the opposite direction, and the spring 39 is compressed while the spring 36 expands. Spring 39 being much stiffer than spring 36, the skier obtains much greater rearward support than forward support. The stop 40 secured to cable 38 bearing against the lower part of the boot, the sheath 41 is pressed by flange 42 and controls the opening of the casing, by translation of the casing 41 along cable 38.

The locking system for the boot top illustrated by way of example includes two pins 13 and 13' connecting the rear part 7 of the boot top to the forward part 5 thereof.

Another possible contruction provides a narrow strip along one side of the boot top encircling the front or the rear thereof and secured to the opposite side of the boot top by a single pin.

Still another embodiment provides a narrow strip on each side of the bottom top encircling the front or rear of the boot top and locked to each other by a single pin.

FIGS. 14, 15 and 16 show another embodiment in which the upper 3 is locked to the shell bottom 2 by pins provided with rounded ends 47 and 47', and the forward part 5 is locked to the rear part by round end pins 48 and 48' disposed on each side of the boot top and acted on by springs 49, 49', 50 and 50'.

The ends of these round-ended pins come to rest in the operative position in blind recesses of complementary configuration which thus constitute a ball locking system.

Upon excessive forward bending, the pins 47, 47' and 48, 48' pop out of their sockets against the action of springs 49, 49' and 50, 50', and the casing opens and frees the foot of the skier. During excessive torsion, a pin 51 fixed to the ski slides plate 52 forwardly of the boot by coacting with a triangular opening in plate 52.

By means of ramps 53, 53', the members 54 and 54' are retracted against the action of spring 58, and hence the pins 47 and 47' are retracted. Cables 55 and 55', of which one end is fixed to plate 52 and the other end to pin 48 or 48', control the retraction of pins 48 and 48' by means of sheaths 56 and 56' of which one end is fixed to base 2. The upper is released as in the example of FIGS. 1–6 and 13, and the foot thus freed.

In this embodiment, the release of the foot is effected by simple traction on the lever 57 which draws plate 52 to the rear and unlocks the pins 47 and 47' and, by means of cables 55 and 55' and sheaths 56 and 56', unlocks the pins 48 and 48'. Thus the skier may freely withdraw his foot with the sock on it, from the casing.

Figure 8:
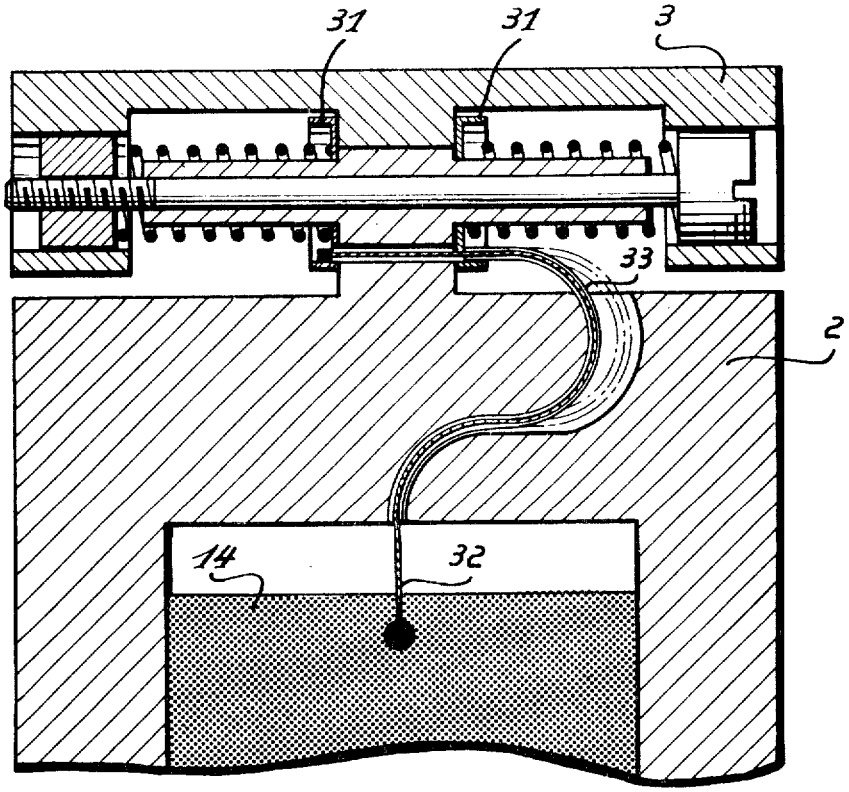
FIG. 8 is a cross-sectional view from above of the articulation of the upper on the base and of the unlatching control upon falling forward, in a particular embodiment. The cable and its sheath are shown in full line in the rest position and in phantom line in the unlatching position.

In the illustrated example, the unlatching upon bending is effected by comparison of a given value of bending amount or couple between the boot top and the base 2. This couple is thus internal to the boot. By contrast, the unlatching upon torsion is effected by a comparison of a given value of couple between the base 2 and the ski 30. This couple is a couple external to the boot. However, it is possible to conceive an embodiment in which the unlatching in torsion is as a result of a comparison of a given value of couple between the upper 3 and the base 2. Such a couple would then be internal to the boot. Such a system is illustrated in FIG. 8. In FIG. 8, the sole is fixed (permanently or releasably) to the ski. The upper is elastically connected to the base by an arrangement analogous to that described in Swiss Pat. No. 465,466. Upon excessive torsion, the lateral displacement of the upper spreads apart the two rings 31 and effects, by means of cable 32 and sheath 33, of which one end is secured to the base 2, the displacement of plate 14 forwardly of the boot and the coupling of the casing by an arrangement analogous to that described above.

In the embodiment illustrated by way of example, the unlatching upon forward falling is controlled by comparison to a predetermined adjustable value, of the couple, or of the force, or the angle between the rear part 7 of the boot top and the base 2. But this could also be controlled by measurement of the couple, or of the angle, or of the force between the rear part 7 and the ski 30.

The illustrated embodiment as well as its modifications are all characterized by a casing of four parts articulated about axes perpendicular to the lengthwise axis of the ski and locked by two closing systems. These embodiments are given only by way of example. Other constructions may be provided, such as with axes of articulation parallel to the ski, or a single closure, for example, without departing from the scope of the invention.

Also, although mechanical unlatching systems have been disclosed, it is evident that within the scope of the invention other control systems could be used such as electronic, electrical, pneumatic, etc.

Referring now to FIGS. 21–25, a device is shown comprising a central sole or rigid shell base 61, in the form of a trough secured to a base plate 62. At its forward end is articulated a rigid member 63 which is also in the form of a trough, pivotally connected thereto at 64, 64'. At the rear end of trough 61 is articulated a rigid element in two parts 65, 65' also in the form of a trough, these latter being articulated to each other at 66, 66' and to central trough 61 at 67, 67'.

The pivotal axes 64, 64' and 67, 67' are horizontal, fixed and perpendicular to the longitudinal axis of trough 61; while the axis 66, 66' is also horizontal and perpendicular to the longitudinal axis of trough 61 but is swingable relative to trough 61 in the arc of a circle about axis 67, 67'.

Figure 21A:
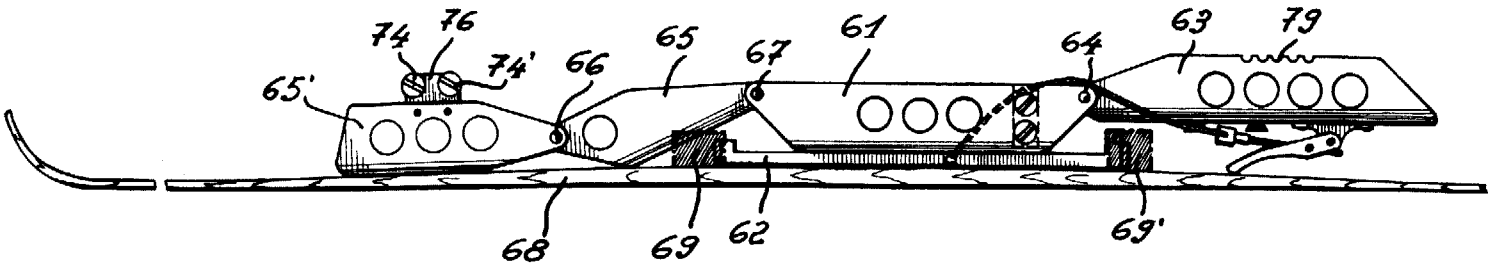
FIGS. 21A and 21B are schematic views, respectively in elevation and top plan, of another embodiment in its position when out of use.
Figure 21B:
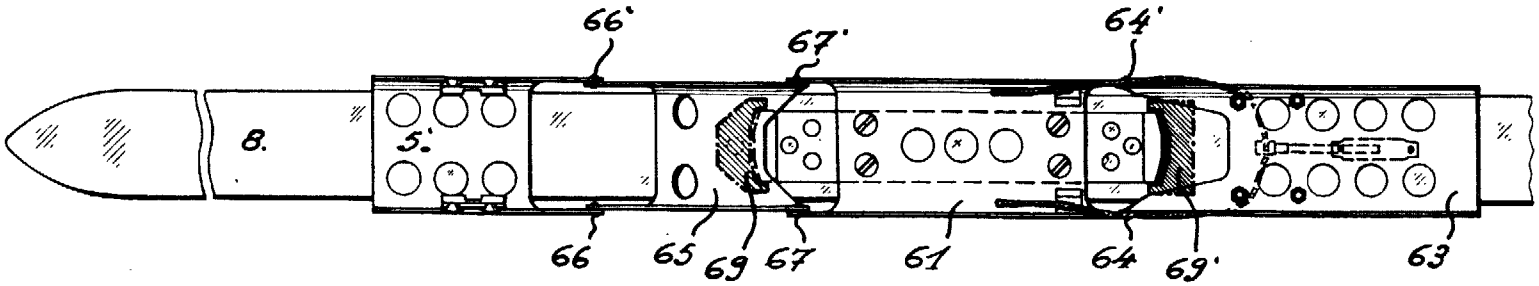
Figure 22A:
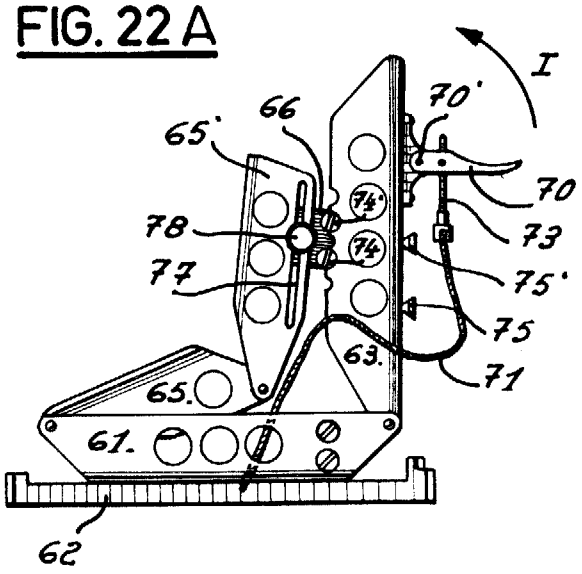
FIGS. 22A and 22B are somewhat schematic side elevational views of the embodiment of FIGS. 21A and 21B in partially out-of-use position and in use position, respectively.
Figure 22B:
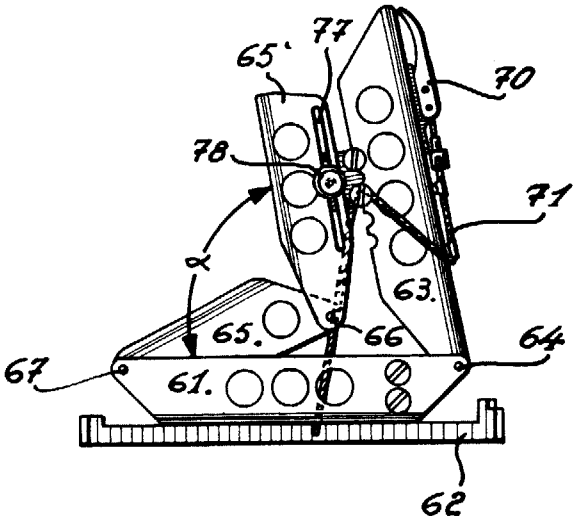

Base plate 62 is adapted to be fixedly secured to ski 68, for example by means of known bindings comprising a rear abutment 69 and a clamp 69'. In the out-of-service position, for example for transportation, the device can be folded down as shown in FIGS. 21A and 21B, the element 63 being completely swung forwardly and the elements 65, 65' being completely swung rearwardly. Four rigid elements 61, 63, 65 and 65' are thus disposed parallel to the ski and in line with each other. The volume occupied is thus reduced to a minimum, particularly as to its height. On the other hand, in the operative position, as shown in FIGS. 22A and 22B, the element 63 is moved rearwardly while the elements 65, 65' are swung forwardly, the pivotal axis 66, 66' describing the arc of a circle having as its center the axis 67, 67', and the element 65' thus becoming about parallel to element 63. In this embodiment, the apparatus accoording to the invention is provided with means for locking the rigid elements 61, 63, 65 and 65' in operative position, and constituted for example by a pull cable comprising clasp 70 carried by the rear member 63, as shown in FIGS. 22A and 22B, and a cable 71 secured to trough 61 and connected to clasp 70 by means of an adjustment screw 73, permitting one to adjust the length of cable 71. To lock the device, the cable 71 is passed about the pins 74 or 74' and 75 and 75', and then the clasp 70 is swung in the direction of the arrow I in FIG. 22A to the position shown in FIG. 22B, swinging about the pivot 70'. The pins 75 and 75', which are screw heads, are fixed to the rear element 63, while the pins 74 and 74' are fixed to a plate 76 which may be either fixed on the forward element 65' or may slide vertically in an opening 77 provided in element 65, for example by means of a screw-threaded pin fixed to plate 76, a knurled knob 78 permitting the fixing of the plate 76 in a predetermined position relative to the opening 77. The pins 74 and 74', which are screw heads, have also the function of connecting the element 65' with the rear element 63, and cooperate with a series of indentations 79 provided on the forward edge of element 63, so as to fix the relative position of the two rigid elements 63 and 65'.

Figure 23A:
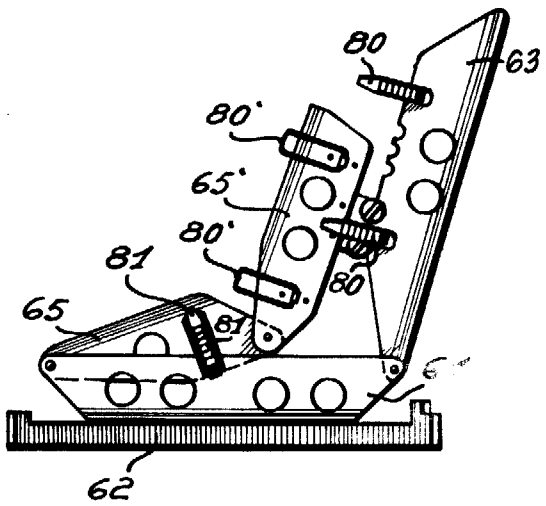
FIGS. 23A and 23B are views similar to FIGS. 22A and 22B, respectively, but of a modified form of the device.
Figure 23B:
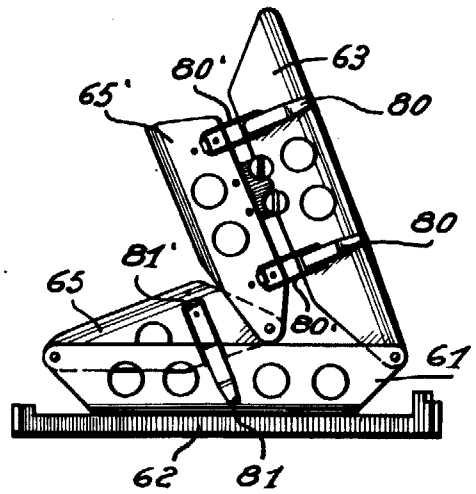

Another embodiment of locking means for the rigid articulated elements is shown in FIGS. 23A and 23B, and is comprised by a system of clasps and buckles. The device of the present invention is thus locked in operative position (FIG. 23B) by clasps 80 and 81 which are secured respectively on the rear element 63 and on the sole 61 and that cooperate with buckles 80' and 81' secured respectively on that part of the forward element 65' which is parallel with element 63 and on the part of forward element 65 which is articulated on the sole 61.

Figure 24:
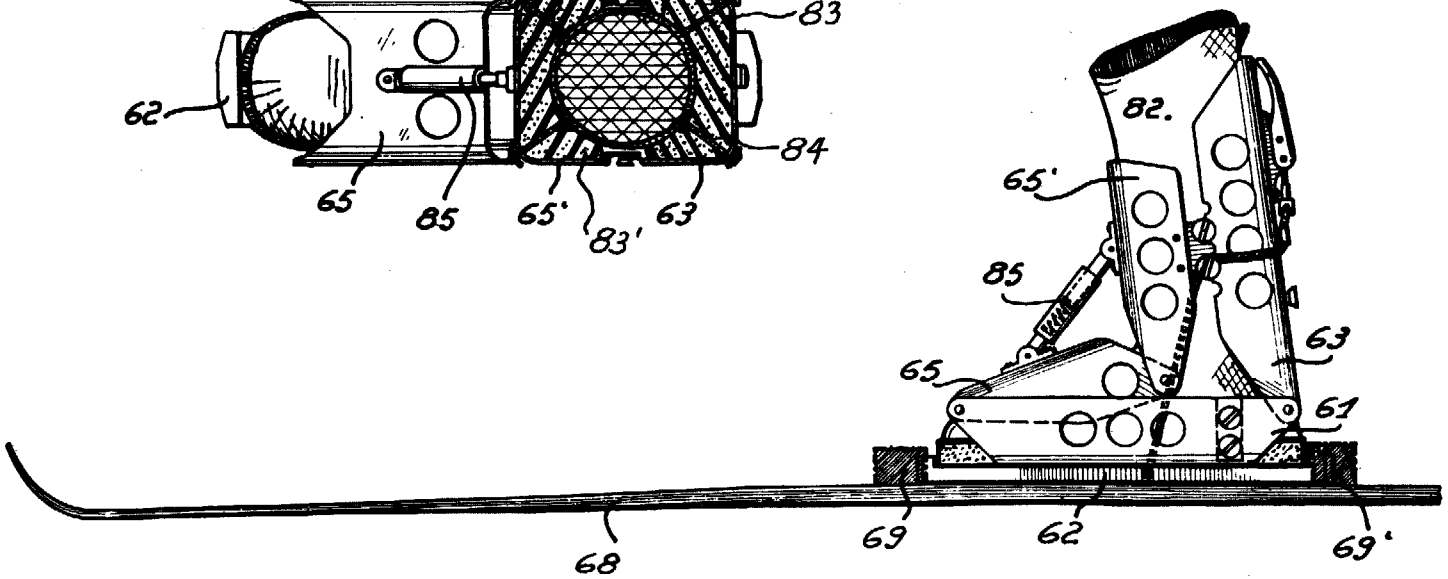
FIG. 24 is a side elevational view of a binding similar to those of FIGS. 22 and 23, in use with a boot and secured to a ski.

FIG. 24 shows an elevational view of apparatus according to the invention in its use position, that is, cooperating with a ski boot 82 so as to maintain the latter on the sole 61. As will be seen from FIG. 24, the element 65 comprises the rigid part retaining the instep, while elements 65' and 63 form a rigid boot top to retain the ankle and the lower part of the leg. As a ski boot utilizable with the device of the invention, a flexible boot, comfortable and watertight may be used, the necessary rigidity being provided by the device itself.

Figure 25:
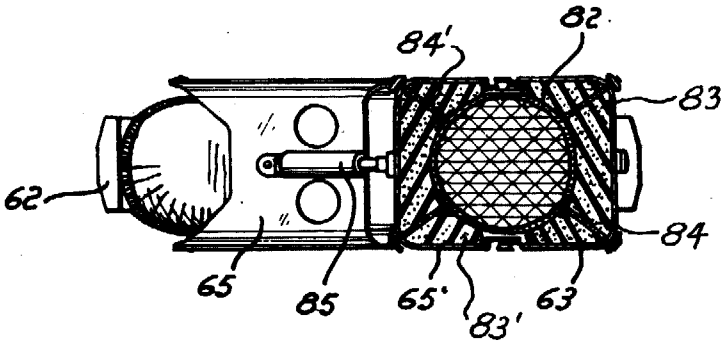
FIG. 25 is a top plan view, partly in section, of the embodiment of FIG. 24.

This boot 82 may comprise an external shape built up by flexible pads to fit the interior of the clamps which are comprised by the rigid elements 63, 65 and 65'. When the boot is plain, the device may be provided with anatomical supports 83, 83' disposed in the anatomical regions subject to the gripping force of the jaws, for example about the ankle and over the instep. These anatomical supports 83 and 83' may be secured for example to the elements 63 and 65', as shown in FIG. 25, by means of screws 84, 84' provided with locking bolts permitting the internal configuration of the supports to be somewhat modified and to secure them more or less strongly against the ski boot. In another embodiment (not shown) the rigid elements 61, 63, 65 and 65' may themselves have a shape complementary to that of the exterior of the boot.

In this embodiment, the locking of the articulated elements 63, 65, 65' may alo be effected by means acting on the pivot of each of the articulations. Moreover, shock absorption means may also be provided to absorb bumps transmitted by the ski to the skier, for example by means of a spring-damping piston 85 as shown in FIG. 24, disposed obliquely between the elements 65 and 65' of the device.

The rigid elements 61, 63, 65 and 65' comprising the apparatus according to the invention should be made of a material which is both light in weight, resistant and rigid, for example aluminum or aluminum alloy, or other light metal alloy, or preferably reinforced plastic, the rigid elements being in the form of open work, as shown in FIGS. 21-25.

This apparatus provides for a rigidification of the boot on the ski, as required for example in competition, by locking all the locking means and blocking means of the rigid elements and/or the articulations. Moreover, the angle $\alpha$ shown in FIG. 22B between the horizontal axis of the sole 61 and the boot top, constituted for example by two rigid elements 65, 65', which is to say between the ski and the leg of the skier, may be selected, before fixing the articulated members in place, by the relative displacement of the two rigid elements 65, 65' parallel to each other and by the predetermined positioning of the pins 74 in the recesses 79, or by securing the plate 76 in the opening 77 or even by setting an analogous slide member (not shown) in a predetermined position. On the other hand, the apparatus according to the invention, as described above, may also be provided for ski tracking; it suffices in that case for example not to lock completely the rigid elements, so that the boot will be retained by the elements 65, 65', but so that the pivotal articulations 64, 64', 66, 66', 67 and 67' will remain free, as well as the structure ensuring the parallel sliding relative to each other of the two rigid elements 65, 65' (see FIGS. 22A and 22B).

Figure 26B:
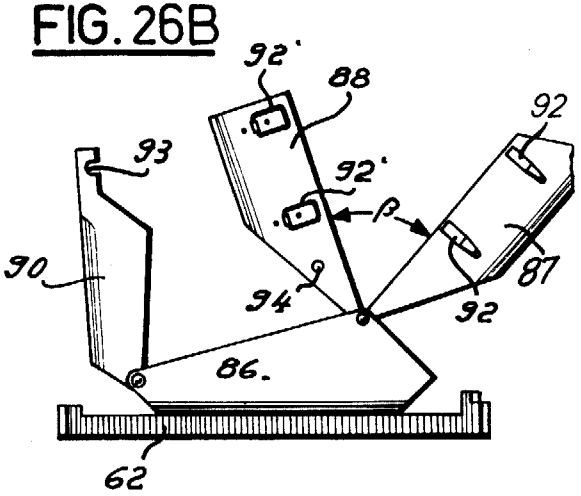
FIGS. 26A, 26B and 26C are somewhat schematic side elevational views of a final embodiment of the invention, respectively in the positions it assumes when out of use, partly in use, and in use.
Figure 26C:
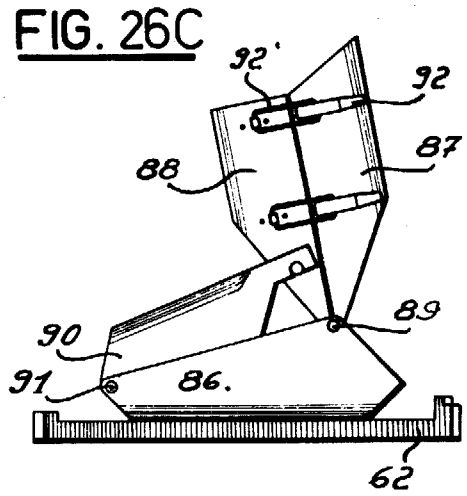
Figure 26A:
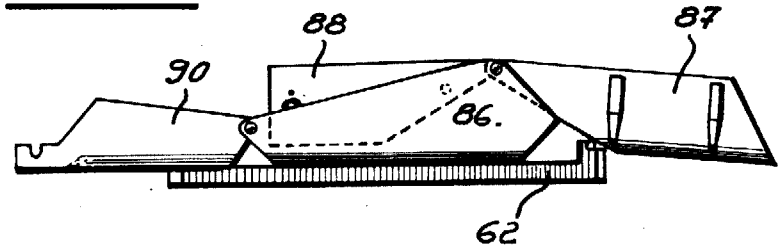

With reference to FIGS. 26A, 26B and 26C, a final form of embodiment of the present invention again comprises three rigid elements articulated on a rigid central sole; however, their disposition is different from that of the first embodiment described with respect to FIGS. 21-25: thus, the sole 86, which may be fixed on base 62 for securement to a ski, has two rigid elements 87, 88 articulated on the rear part and in this case on the same axis 89, and a rigid element 90 articulated at the forward end of sole 86 on an axis 91. In the out-of-service position, as shown in FIG. 26A, this embodiment occupies minimum volume, and the angle $\beta$ (see FIG. 26B) permits the introduction of the ski boot (not shown) between the two rigid elements articulated on the rear part of the sole 86. In operative position, as shown in FIG. 26C, the device may be locked for example by means of buckles 92' and clasps 92 or other locking means, such as those described in the preceding embodiment. Rigid element 90, articulated on the forward part of sole 86, may also have a hook 93 at its free end, cooperating in the operative position with a pin 94 carried by one of the two rigid elements that are articulated on the rear part of sole 86. Other features such as the means for preventing swinging movement, safety devices, the form of the rigid elements, the anatomical supports, etc. are analogous to those described in connection with the embodiment shown in FIGS. 21 to 25.

The boot to be fixed on the ski by means of the apparatus according to the invention is preferably a comfortable flexible boot providing warmth, watertightness and which may be dressy. It may also be worn as desired, apart from the ski, as a hiking boot, an after-ski boot, etc. The apparatus of the present invention will impart to it the required rigidity when used as a ski boot.

What is claimed is:

1. Apparatus for connecting the leg of a skier to a ski, comprising a rigid casing in at least three parts, means articulatedly interconnecting said parts for vertical swinging movement relative to each other about a plurality of horizontal axes that are perpendicular to the length of the ski, means for fixing the casing to a ski, locking means for releasably securing together said parts of said casing in a position closely to surround a lower extremity of a skier, and means to release said locking means thereby to release said parts from locked together position responsive to the imposition by the leg of the skier on at least one of said parts of a force greater than a predetermined maximum thereby to release said lower extremity from said apparatus, said casing comprising a base and an upper articulated on the forward end of the base, a rear part of a boot top articulated on a rear portion of said base, and a front part of a boot top articulated on one of a rear portion of said upper and a rear portion of said base.

2. Apparatus as claimed in claim 1, said means to release said parts comprising a plate mounted for sliding movement on and relative to said base in the plane of the plate, and means responsive to relative movement between said plate and said base to release said locking means thereby to open said casing to free the foot of the skier.

3. Apparatus as claimed in claim 2, and a cable connecting said plate and a portion of said casing that is swingable forwardly and rearwardly relative to said base, whereby forward or rearward movement of said casing portion moves said plate relative to said base.

4. Apparatus as claimed in claim 1, and means resiliently mounting said upper for horizontal translatory movement relative to said base.

5. Apparatus as claimed in claim 1, and two elastic systems between the base and the boot top, one said system resisting forward bending movement of the boot to relative to the base and the other elastic system resisting rearward bending movement of the boot top relative to the base with a force greater than the force of the first-mentioned elastic system.

6. Apparatus as claimed in claim 5, and means responsive to forward or rearward bending movement of the boot top relative to the base in excess of a predetermined maximum, to release said locking means to release the foot of the skier.

7. Apparatus as claimed in claim 1, and means responsive to forward to rearward bending movement of the boot top relative to the base in excess of a predetermined maximum, to release said locking means to release the foot of the skier.

8. Apparatus as claimed in claim 1, said front part being articulated on a rear portion of said upper.

9. Apparatus as claimed in claim 1, said front part being articulated on a rear portion of said base.

10. Apparatus as claimed in claim 1, said rigid articulated parts being in the form of troughs.

11. Apparatus as claimed in claim 1, in which the pivotal axes of said elements are fixed.

12. Apparatus as claimed in claim 1, and a flexible waterproof sock disposed between said articulated elements.

* * * * *